US008840399B2

(12) United States Patent
Alusi

(10) Patent No.: US 8,840,399 B2
(45) Date of Patent: Sep. 23, 2014

(54) METHOD FOR PRODUCING CANDLES COMPRISING DECORATIVE AND/OR FUNCTIONAL ELEMENTS

(75) Inventor: Maha Alusi, Berlin (DE)

(73) Assignee: Alusi Europa Limited, Dublin (IE)

( * ) Notice: Subject to any disclaimer, the term of this patent is extended or adjusted under 35 U.S.C. 154(b) by 991 days.

(21) Appl. No.: 11/569,453

(22) PCT Filed: May 27, 2005

(86) PCT No.: PCT/DE2005/000986

§ 371 (c)(1),
(2), (4) Date: Nov. 30, 2007

(87) PCT Pub. No.: WO2005/116176

PCT Pub. Date: Dec. 8, 2005

(65) Prior Publication Data

US 2008/0268390 A1 Oct. 30, 2008

(30) Foreign Application Priority Data

| | | |
|---|---|---|
| May 27, 2004 | (DE) | 10 2004 027 342 |
| Aug. 27, 2004 | (DE) | 20 2004 013 665 U |
| Nov. 25, 2004 | (DE) | 10 2004 057 456 |
| Mar. 15, 2005 | (DE) | 10 2005 012 181 |

(51) Int. Cl.
*F23D 3/16* (2006.01)
*C11C 5/00* (2006.01)

(52) U.S. Cl.
CPC ..... *C11C 5/008* (2013.01)
USPC ..... 431/288; 431/289; 431/126; 431/325; 431/255; 264/168; 264/245

(58) Field of Classification Search
USPC ..... 431/288, 289, 126, 325, 255; 264/168, 264/245, 138
See application file for complete search history.

(56) References Cited

U.S. PATENT DOCUMENTS

| | | | | | |
|---|---|---|---|---|---|
| 2,196,509 | A | | 4/1940 | Turner | |
| 2,379,391 | A | | 6/1945 | Turner | |
| 2,845,785 | A | | 8/1958 | Weglin | |
| 3,287,484 | A | * | 11/1966 | Justus | 264/245 |
| 3,586,473 | A | * | 6/1971 | Galloway et al. | 431/126 |
| 5,567,145 | A | * | 10/1996 | White | 431/288 |
| 5,833,906 | A | * | 11/1998 | Widmer | 264/245 |
| 5,944,509 | A | * | 8/1999 | Masters et al. | 431/288 |
| 6,056,541 | A | * | 5/2000 | Gerszewski | 431/288 |

(Continued)

FOREIGN PATENT DOCUMENTS

| | | | |
|---|---|---|---|
| EP | 0 018 839 | A | 11/1980 |
| EP | 0 719 855 | A1 | 7/1996 |

(Continued)

*Primary Examiner* — Avinash Savani
(74) *Attorney, Agent, or Firm* — Norris McLaughlin & Marcus PA

(57) ABSTRACT

The invention relates to a method for producing candles, to the candles produced by this production method and to the device used in the production thereof. The invention relates to a novel method for producing candles ranging from simple shapes to decorative, ornamental, three-dimensional objects, from slabs of wax, wax profiles and wax molds, comprising an independently inserted wick, e.g. linear, arched or branched, and to a novel device for producing decorative slabs of wax as semi-finished products, inter alia for use in the above-mentioned method for producing candles. The invention also relates to candles that are produced using said device and said method.

9 Claims, 16 Drawing Sheets

(56) References Cited

U.S. PATENT DOCUMENTS

Figure 1:
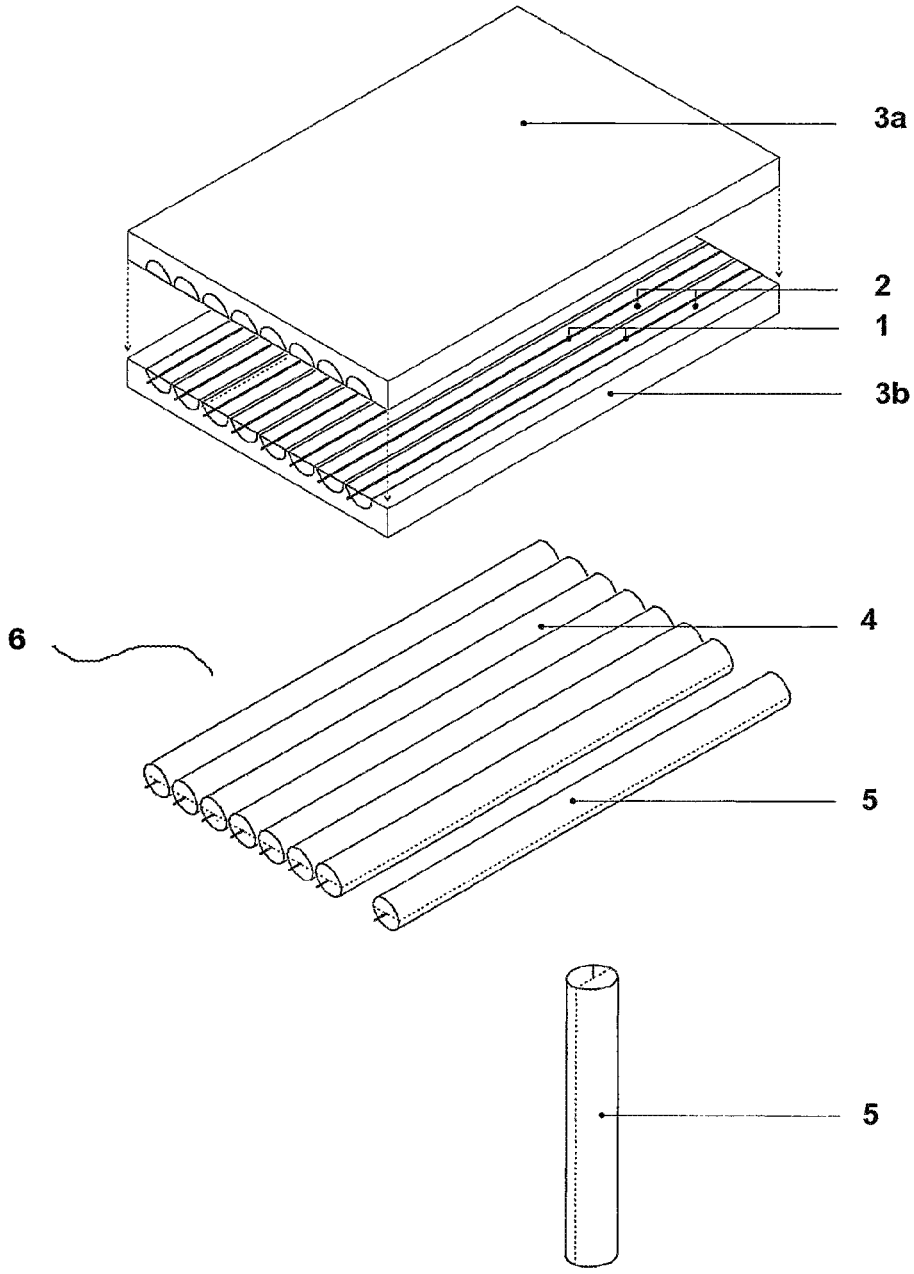

| | | | | |
|---|---|---|---|---|
| 6,551,099 | B1 * | 4/2003 | Kapinski | 431/288 |
| 6,607,377 | B2 * | 8/2003 | Latzel | 431/295 |
| 6,733,280 | B1 * | 5/2004 | Livne et al. | 431/288 |

FOREIGN PATENT DOCUMENTS

| | | | |
|---|---|---|---|
| FR | 1 482 544 | A | 5/1967 |
| GB | 2 196 017 | A | 4/1988 |
| GB | 2 300 647 | A | 11/1996 |
| GB | 2300647 | | 11/1996 |
| JP | 54-160068 | | 12/1979 |
| JP | 54-175880 | | 12/1979 |
| JP | H09-137186 | | 5/1997 |
| JP | 2003-055689 | | 2/2003 |
| WO | 86 04918 | A | 8/1986 |
| WO | 01 42406 | A | 6/2001 |

* cited by examiner

METHOD FOR PRODUCING CANDLES COMPRISING DECORATIVE AND/OR FUNCTIONAL ELEMENTS

The invention relates to a method for producing candles as well as to candles produced by this method and the apparatus used for producing.

There are various possibilities to produce candles. These vary from using modern technology to ancient craftsmanship. Most candles nowadays are produced with candle drawing machines or the methods of powder- or paraffin block pressing. Another method is pouring wax in moulds in the centre of which the wick is clamped. Furthermore, even today one of the oldest methods is used, viz. the repeated vertical dipping of the wick into a liquid wax mass, i.e. candle dipping.

All these methods are based on the principle of a wick inserted axially into the mass of wax, e.g. drawing a wick through a mass of wax, clamping a wick vertically in a casting mould or mounting the wick in the centre of the press cylinder.

The various properties of the wax, whether based on paraffin or stearin, or mixtures thereof, considered both per se and in their interaction with the wick and the flame, have not by far been exhausted with the presently known methods.

From EP 0719855 B1, a method of producing candles is known, that is based on hardening high-contrast coloured layers or oblong elements of paraffin and afterwards subjecting them to a final cutting step for modelling.

GB 2300647 describes a method of producing candles. The production is based on a casting method in handcraft.

A problem with the production methods known and used up to now is that they do not offer the possibility to provide a candle with functional elements without extensive effort. Functional elements are intended to mean arrangements of a candle that influence the burning behaviour of a candle, wherein the influence on the burning behaviour is achieved purposively by means of the functional elements incorporated during the production process.

Furthermore, the presently known methods for producing candles and devices used therein, and are limited, as to the decoration of a candle, to the combination of differently coloured inflammable masses in layers produced vertically separated, that have been fused together, or to the applying decorations to a finished candle.

Starting from this prior art, it is the object of the present invention to provide a new production method for candles, that allows to produce candles with decorative and/or functional elements, as well as candles that comprise decorative and functional elements and the devices required to produce such candles.

The object is achieved by the independent claims.

In the sense of the present invention, decorative elements are meant to comprise arrangements ranging from various designs to decorative, ornamental or three-dimensional combinational possibilities. Moreover, the concept of decorative elements are intended to comprise the embodiment of a candle with aromatic substances, that are set free at predetermined times, depending on the burning time of the candle.

Functional elements are intended to mean the purposive build of a candle, that influences, on the one hand, the burning behaviour of the candle, and on the other hand, during burning of a candle, also the shape and external appearance of the candle.

According to the invention, there is thus provided a candle with decorative and/or functional elements with at least one inflammable wick, comprising at least one segment which is made up of a cured inflammable mass, wherein a segment is composed of at least two layers in a geometrical form, and at least one inflammable wick that extends within the geometrical form, wherein in a respective upper candle segment the wick(s) project from the inflammable mass, and in a central candle segment the wick(s) does/do not protrude from the inflammable mass and is/are fixed at the lower end by a lead, wherein the wick is held at its lower end by a lead in a respective lower candle segment, and wherein the wicks are situated in such a distance to each other in and between the individual candle segments, that the flame jumps over from one wick to the next within the segment or within the respective next segment, while the candle is burning down.

In a preferred embodiment, at least one segment is curved and/or the wick branches at least once, while in the case of branching linear wick sections are present as well as elements, arranged at the respective ends, for connection with additional segments.

The wick of a candle according to the invention is preferably coated with a further layer of an inflammable material. According to the invention it is provided that the flammable material with which the wick is coated differs from the flammable material of the candle. Furthermore, it is provided that the wick of an embodiment according to the invention comprises a guide of metal or glue.

In a preferred embodiment of the candle according to the invention, the wicks of neighbouring segments do not touch. The burning behaviour of a candle according to the invention is influenced by the pigments in the wax and/or in the wick, these having a special influence on the burn time of a candle according to the invention. Furthermore, the burning behaviour may be influenced by the choice of the material of the used wick. Preferably, to that end there is provided a porous, flammable material, that comprises a predetermined proportion of gypsum, in addition to flammable parts.

In a further embodiment of a candle according to the invention, cavities are provided in the flammable material of the candle. These cavities are filled with differently coloured wax and/or aromatic oils, depending on the realised embodiment of a candle according to the invention. Herein, the cavities have the shape of geometrical shapes, numbers, letters or combinations thereof.

A further aspect of the present invention is a segment for producing a candle with decorative and/or functional elements with one or multiple flames, consisting of a cured inflammable mass which is put together of at least two layers in a geometrical form as well as a wick extending within the geometrical form.

In a segment according to the invention, preferably, the wick is curved and/or branches at least once, wherein, in the case of branching, linear wick sections are present as well as elements, arranged at the respective ends, to connect with additional segment.

Furthermore, there is provided a segment for producing a candle with decorative and/or functional elements, consisting of a cured inflammable mass which is put together of at least two layers in a geometrical form, wherein at least one cavity filled with a different-coloured inflammable mass and/or a fragrant oil, is present inside the cured inflammable mass, and comprising a wick extending inside this geometrical form as well as elements arranged at the respective ends to connect with additional segments.

According to the invention, the segments preferably comprise a tongue and groove, plug- and/or clamp connection. The transition of the wick of a segment according to the invention is provided with a pluggable wire cover.

Inasmuch as cavities are provided in a segment according to the invention, preferably these are in the shape of geometrical shapes, numbers, letters, or combinations and filled with wax and/or aromatic oils.

In a segment for constructing a candle, according to the invention, decorative and/or functional elements are visible depending on the burning time of the candle. Depending on the embodiment, a segment according to the invention is also provided able to burn as a separate candle.

Furthermore, there is provided a candle according to the invention, with decorative and/or functional elements, that is composed of at least two identical segments, or combinations of segments according to the invention.

A further aspect of the present invention is a method for producing a candle with decorative and/or functional elements, wherein the elements respectively provided for are inserted through the combination of adequate layers during the production process and every layer is arranged individually with respect to the required elements through the selection of suitable materials and/or the respective modelling, such that first a positive form of the candle to be produced is made of a solid material, this positive form is inserted in a mould, that is completely filled with a suitable material in a horizontal position, and subsequently the form is separated in the required number layers, whereby negative forms of the required layers are obtained, and subsequently the layers of the candle are produced using the negative forms, and before joining the layers of the candle, at least one linearly extending wick, curvedly extending wick or wick that branches at least once is inserted between the layers of the candle.

A preferred method according to the invention is characterized by constructing the candle from layers, that comprise recesses or cavities. Alternatively, the method according to the invention may also be embodied in that, by stacking of various layers, the recesses are connected with one another to closed cavities.

Furthermore, the method according to the invention provides that, after joining the layers of the candle, geometrical forms, numbers, letters or combinations thereof are created by the present cavities. Depending on the embodiment of the method according to the invention, these cavities are filled with differently coloured flammable material or an aromatic substance, before or after the complete assembly of the candle.

In the method according to the invention, preferably, there is inserted a wick that is coated with a thin cured layer of flammable material, and is thus cured into a wick tree in its predetermined shape, before inserting it into the candle.

In order to position the wick or wick tree before combining the layers of the candle, a method step is provided wherein spacers are used to this end. It is also provided that, before combining the layers, the wick or wick tree is completely cast in a layer of the candle to be made, before applying a subsequent layer. Furthermore, in the method according to the invention it is provided that a wick of a porous, flammable material is used.

A further aspect of the present invention is a device for producing segments for constructing a candle, as well as a candle with decorative and/or functional elements. The device according to the invention consists of negative forms of the required layers, produced by placing a positive form of a solid material of the candle to be made in a mould, which is filled completely, in a horizontal position, with a suitable material, and subsequently the negative cast thus obtained is separated in the required number of layers.

The material of the casting mould, i.e. of the negative form, that is present in the mould, of the to be made candle layer of a device according to the invention, preferably consists of silicone.

The invention is a new method for producing candles from a simply shape to decorative, ornamental, three-dimensional objects, of wax slabs, wax profiles and wax moulds, with an independently inserted wick, e.g. linear, curved or branched, as well as a new device for producing decorative wax slabs as semifinished article, inter alia for possible use in the candle production described above. Herein, wax is intended to include similar materials such as stearin or paraffin or the like.

The present invention provides the possibility to design the product in a technological fashion. New possibilities are provided with respect to decorative products, the craftsman's production of which by present day methods is much too complicated. With the new methods, new forms with optimised burning properties may arise.

The present invention allows shaping of a candle in all three spatial dimensions, in its full extent. Taking account of the burning time of a candle as a factor of time, of which the respective appearance of the candle depends, even time is included as a dimension that can be shaped.

The production according to the invention of a candle with the silicone moulds is completely new, for the candle is created in particular lying down. Firstly, a bit of wax is poured into the mould. On top of that, the prefabricated wick tree is positioned. This should extend in each position centrally in the candle's arms. To achieve that, the wicks have spacers of wax. A small but effective solution. This wick tree is now completely filled up with wax. In this way, it is well embedded.

Now, the second half of the silicone mould is placed on top. The remaining cavities are filled with wax through an appropriate opening. This is the only step that is carried out in an upright position. After cooling, the multi-arm candle is finished.

This lying production method provides unforeseen design possibilities for the candle. E.g., in some positions, a wax dot of a different colour may be incorporated. When burning, the following will happen: in a predetermined position, the candle will change its colour. For example, the wax creation thus changes the number of its flames more than once during its burning time of nine hours.

Instead of or as an alternative to the coloured wax dots, aromatic oils may also be incorporated, in various positions. Thus it may happen that, after a few hours, the candle smells like a lemon for a short time, and two hours later maybe like cinnamon. Also, such a candle will vary the number of flames.

When burning, the candle divulges another secret: the outer wicks are supported by wire frames at their ends. Multicoloured pearls may be incorporated into these wire frames. Also, at these positions the other wicks end, so that, after nine hours, yet again a single flame is burning, just like at the start.

Furthermore, the technology according to the invention allows to produce modular building blocks (segments), from which multi wick and multi flame candles may be constructed, by a special plug connection. Herein, various modules are produced, that differ in their respective curvature and/or thickness of the flammable material. Because of this modular principle, three-dimensional candles may also be produced, that have a triangular or circular basic shape in plan view.

Thus, an aspect of the present invention is also a "3-D Ball-candle". The special thing about this candle is that it has a non-flammable skeleton. This may consist of various materials: metal-wick braiding or carbon fibre-wick braiding. The separate wax building block halves, that had been preformed in horizontal moulds, are fixed around this braid structure. The spherical candle offers the possibility to suspend it, because the wire carbon frame will also provide a possibility for fastening, even external from the candle structure.

In the following, various exemplary but non-limiting embodiments of methods according to the invention are described:

1.0 Method for Producing Candles with Linear or Branched Wick

The candles may be shaped in from a simple shape to decorative, ornamental, three-dimensional objects, of wax slabs, wax profiles or wax moulds, with an independently inserted wick.

Two or more wax slabs, profiles or moulds are joined together by lightly heating and pressing together of the surfaces facing each other.

Before pressing the wax slabs, profiles or moulds together, the wick is positioned into the surface. In the case of a casting process the wick is inserted in between two casting steps.

After pressing the wick is fixedly inserted between the wax slabs, profiles or moulds.

The position and orientation of the wick, linear or branched, is thus independent of the wax mass, contrary to all conventionally known methods.

The thickness and nature of the wick fabric may be made according to a desired burning property. E.g., the wick may be thinner at branches and candle portions extending slantingly, in order to control the burning behaviour. The candle may be inserted in any available candlestick, or may be independently stable.

1.1 Production from Wax Slabs

According to the production method described in item 1.0, arbitrary candle shapes may be cut out of wax slabs, along the extent of the linear, curved or branched wick. This new solution allows industrial mass production of conventional candles such as household candles or stumps with a wick in the centre of the inflammable mass, such as e.g. household candles from wax slabs, and the design possibilities that go with it. Furthermore the cost-effective production of ornamental candles having one or more wicks in the centre of the inflammable mass can hereby made possible.

After punching or cutting out along the axis of the wick, a new, ornamental wax candle with special burning properties originates: during burning, multiple flames may arise from a single flame, that continuously change along the ornamental extent of the candle's shape.

1.2 Production from Wax Profiles

According to the production method described in item 1.0, arbitrary candle shapes may be produced from wax profiles. The required wax profiles may be produced in a casting or pressing process.

This new solution enables industrial mass production. Conventional candles such as household candles or stumps with a wick in the centre of the flammable mass, as well as ornamental candles with a wick in the centre of the flammable mass, or branched wicks for creative candle shapes, respectively.

1.3 Method for Producing Candles from Wax Moulds

According to the production method described in item 1.0, arbitrary candle shapes may be produced from wax moulds. The required wax moulds may be produced in a casting or pressing process.

This new solution enables production of new ornamental candles with one or more branched wicks with an optimised burning behaviour. Example: 3D-candle.

1.4 Finishing

All candles shapes or production methods mentioned above may be finished as follows:

- A subtractive finish is carried out through milling and cutting of the cross-section, by a machine or manually.
- A finish by addition is carried out by applying additional layers or by dipping, spraying or coating, mechanized or manually.
- A further method of finishing is transforming, and is carried out thermally, mechanized or manually.

2.0 Method for Producing Three-Dimensional, i.a. Movable Ornamental Candles with Branched Wick. Example According to the production methods described in item 1.0, a two-dimensional candle matrix may be produced by punching or milling.

By rotating along the axis/axes of the wick, a three-dimensional, movable, ornamental wax candle with special burning properties arises from the matrix. Depending on the embodiment of the candle, the wick may be reinforced with a metal bush at the pivot.

This matrix may be marketed as an assembly kit. The end user may turn the matrix into a three-dimensional object, by rotating individual candle parts around an axis and adjusting in a specific position. The metal bushes at the pivots serve reinforcement and prevent a severing of the wick.

Nevertheless, the object may also be marketed as a finished, fixed, three-dimensional candle.

The candle may be inserted into any conventional candlestick or may be independently stable.

3.0 Methods of Production of Wax Slabs as Semifinished Product for Candle Production By combining a plurality of wax slabs or blocks or by specially shaping wax slabs or blocks, new wax slabs arise on cross-section. These slabs may be used as semifinished products for producing candles or other wax forms.

3.1 Methods of Addition 3.1.1. Pixel Matrix Slabs

By joining or pressing wax pens, stepped in colours if desired by design, a new wax slabs arises on cross-section, that may be used as semifinished products for producing candles or other wax forms.

By use of this method a precise and technically controllable pixel matrix can be produced.

3.1.2. Joining

By joining prefab wax slabs of varying thickness and stepped colours, according to design wishes, a new wax slab arises.

The wax slabs thus formed may be rejoined and cut again, whereby in cross-section a new wax slab arises anew. According to design wishes, these slabs may be used as semifinished products for production of candles or other wax shapes.

3.1.3 Pressing

By pressing together arbitrary wax blocks and moulds in arbitrary colours, a wax mass interspersed with cavities arises, which, on cross-section, provides a new wax slab. These slabs may be used as semifinished products for production of candles or other wax shapes.

3.1.4. Filling Up

The cavities of the wax mass mentioned at 3.1.3 may be filled with liquid wax in arbitrary colours. On cross-section, a new slab arises. These slabs may be used as semifinished product for production of candles or other wax shapes.

3.1.5. Incorporating Non-Flammable Objects

By including non-flammable objects between wax slabs and/or in wax masses, a new wax slab arises, that may be used as semifinished product for production of candles or other wax shapes.

3.1.6. Surface Processing

By coloured coating, spraying, or enamelling one or both sides of a wax slab, a new wax slab arises, that may be used as semifinished product for production of candles or other wax shapes.

3.2. Subtractive Methods 3.2.1. Milling or Drilling

By milling or drilling into wax blocks or slabs, cavities arise, that may be filled or occupied. The filling could be e.g.: aromatic oil, a coloured fluid, non-flammable objects and the like. The wax slabs thus produced may be used as semifinished products for production of candles or other wax shapes.

3.2.2. Reusable Form Parts

By pressing form parts (13) into wax blocks or slabs, and removing them again, cavities (10) arise, that may be filled or occupied functionally. The wax slabs (12) thus produced may be used as semifinished products for production of candles or other wax shapes.

3.3. Combining Various Production Steps

Methods by addition and subtractive methods may be combined in an arbitrary number of method steps.

4.0 Methods for Producing Technical Candles 4.1. Decorative, Technical Stump Candles Using the methods describe under item 4, a novel decorative, technical stump candle is produced.

The candle is intended to be a mere decorative object while not burning. However, in the burning process, intended and/or unintended effects occur through the interplay of the individual, functional layers. These effects include e.g.: regulation of the burning time through cavities in the inflammable material, modification of the visible surface, i.e. the appearing of an image that had been hidden before, the modification of integrated, thermally sensitive objects or layers, the appearing of writing or the like, through the controlled running in of wax which liquefied during the burning process, or other liquids into cavities connected to the visible surface.

Further functional assignments include: regulated use of fragrance oil, gel or coloured liquids, sounds, music, chemically induced flame colours and much more.

The burning course is controllable in such a way that an earlier conceived sculptural wax form or decorative cavities appear on the visible surface, or that the candle burns down in its entirety.

Moreover, this product can be combined with all the earlier mentioned new production methods. The candle's shape is arbitrary.

4.2. Multifunction-Candle

By combining all of the above described methods with common casting techniques, new products in greater dimensions and with multiple functions can be created, e.g. a bowl for fruits or a vase made of decorative wax, that can be burned after use.

A wax form, produced with e.g. the casting technique is fused together with a second, matching wax form, under light pressure. Before that, the wick is placed between the two wax forms.

Figure 2:
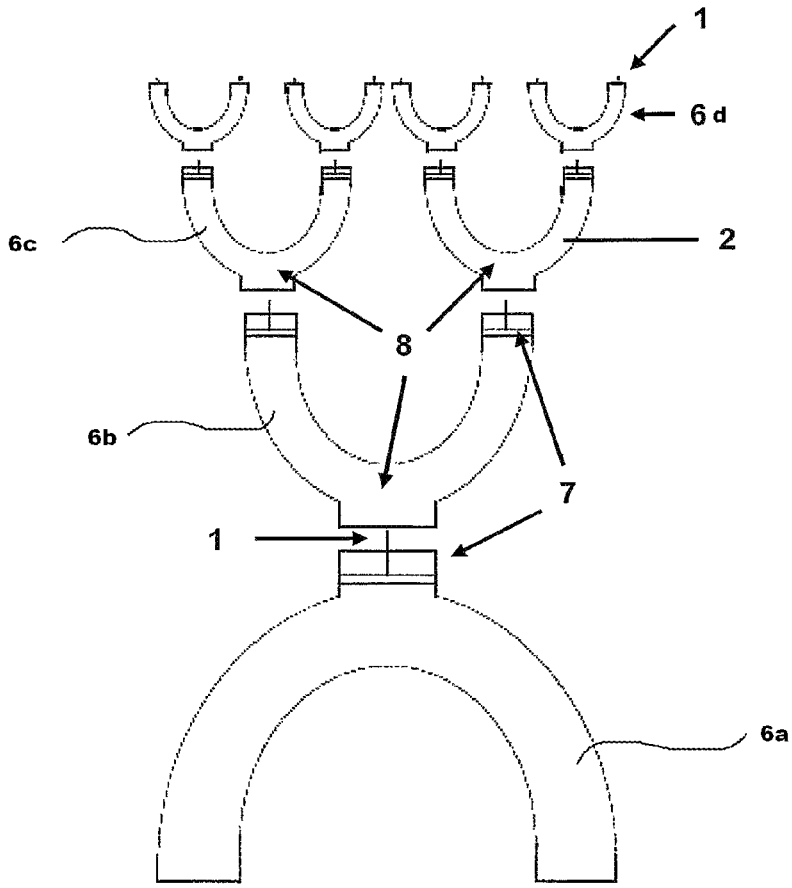
Figure 3A:
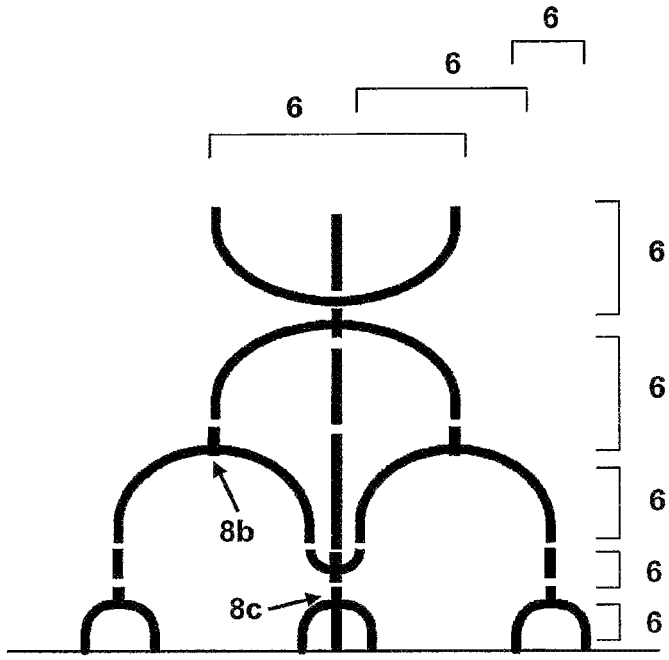
Figure 3B:
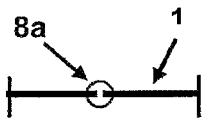
Figure 4A:
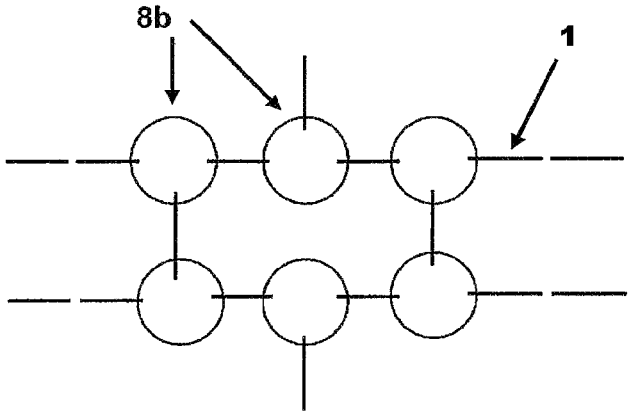
Figure 4B:
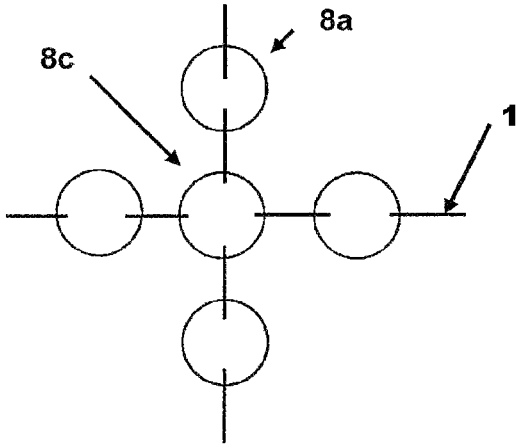
Figure 5A:
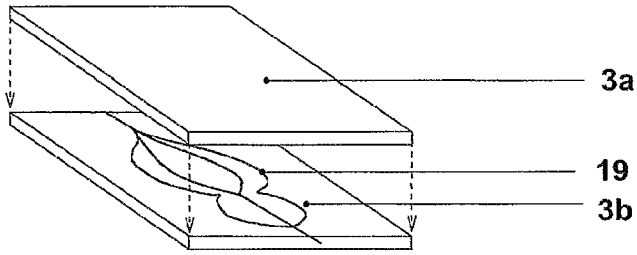
Figure 5B:
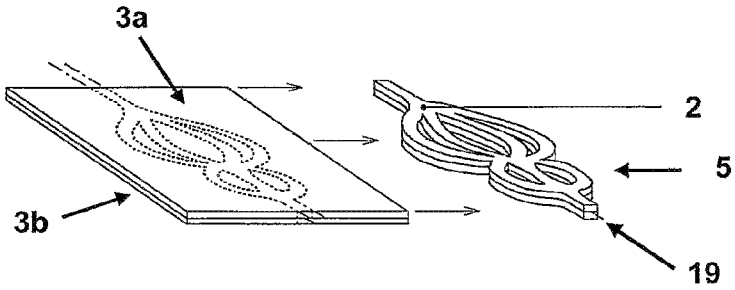
Figure 5C:
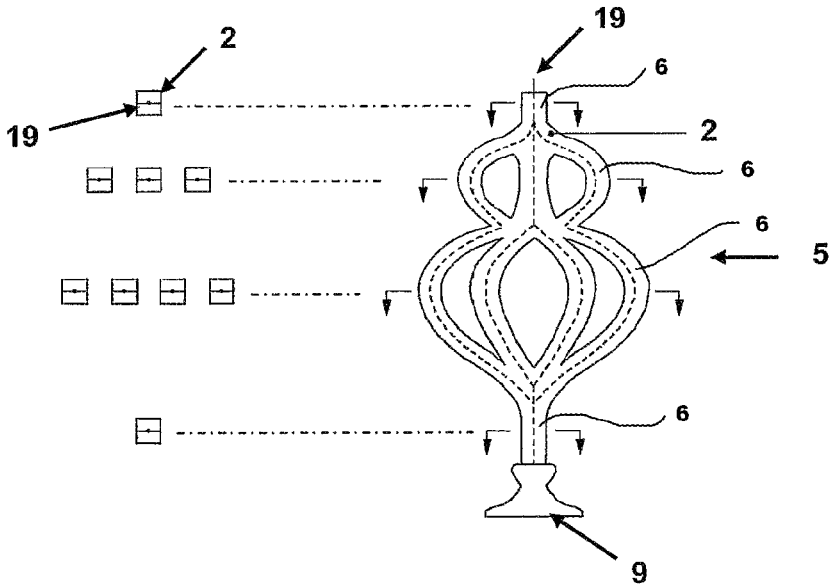
Figure 6:
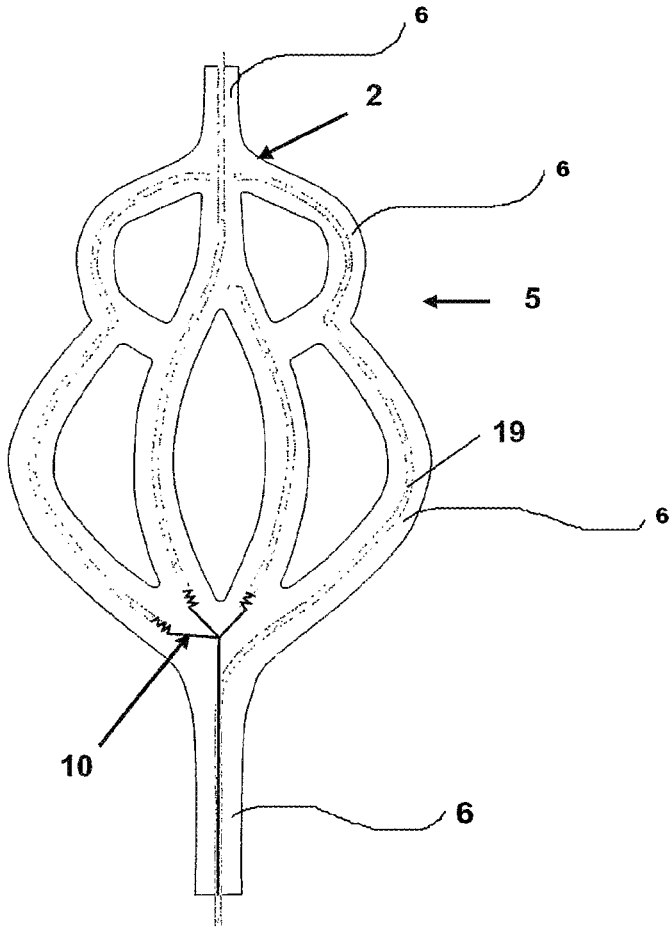
Figure 7A:
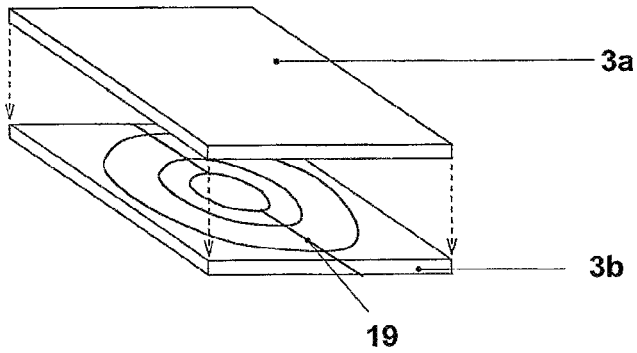
Figure 7B:
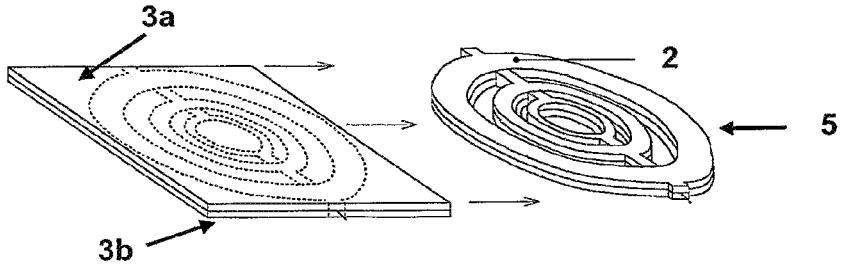
Figure 7C:
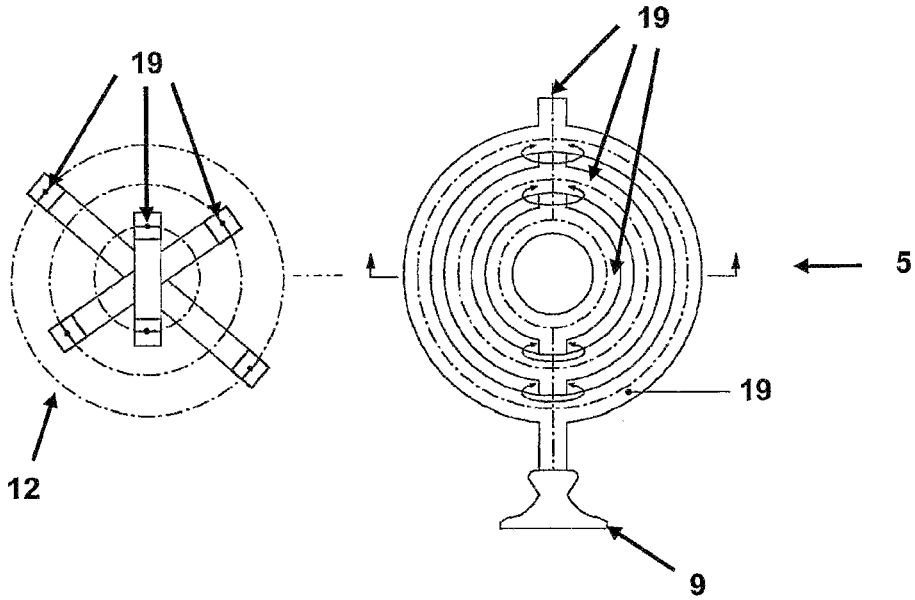
Figure 8:
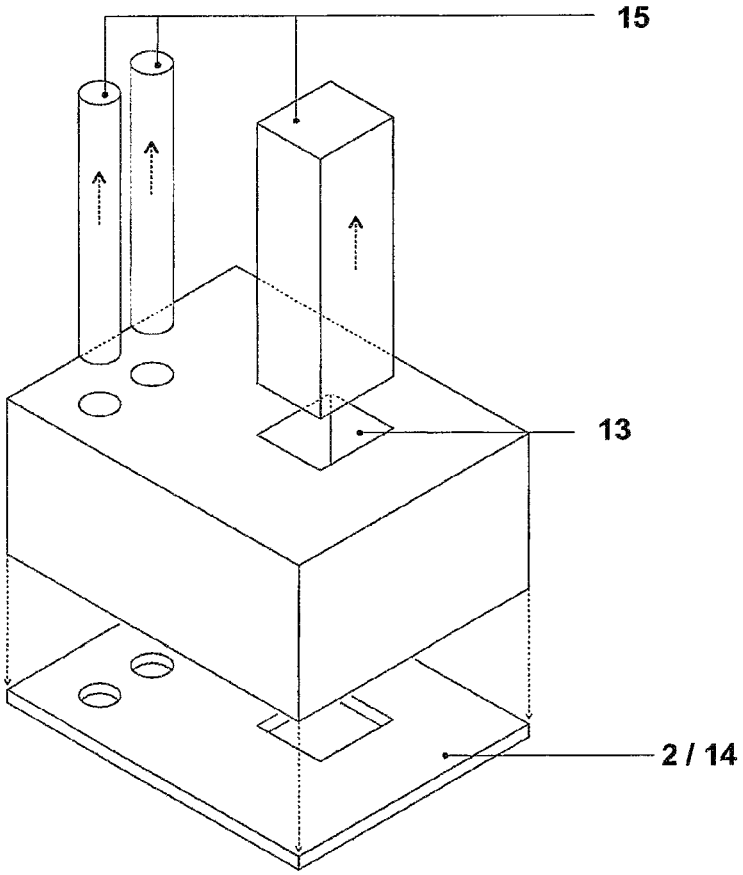
Figure 9:
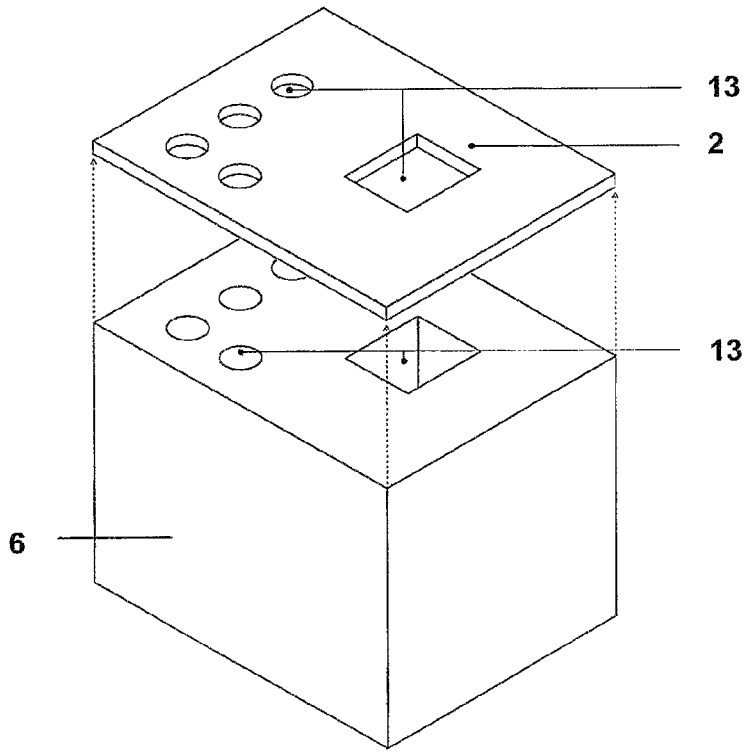
Figure 10:
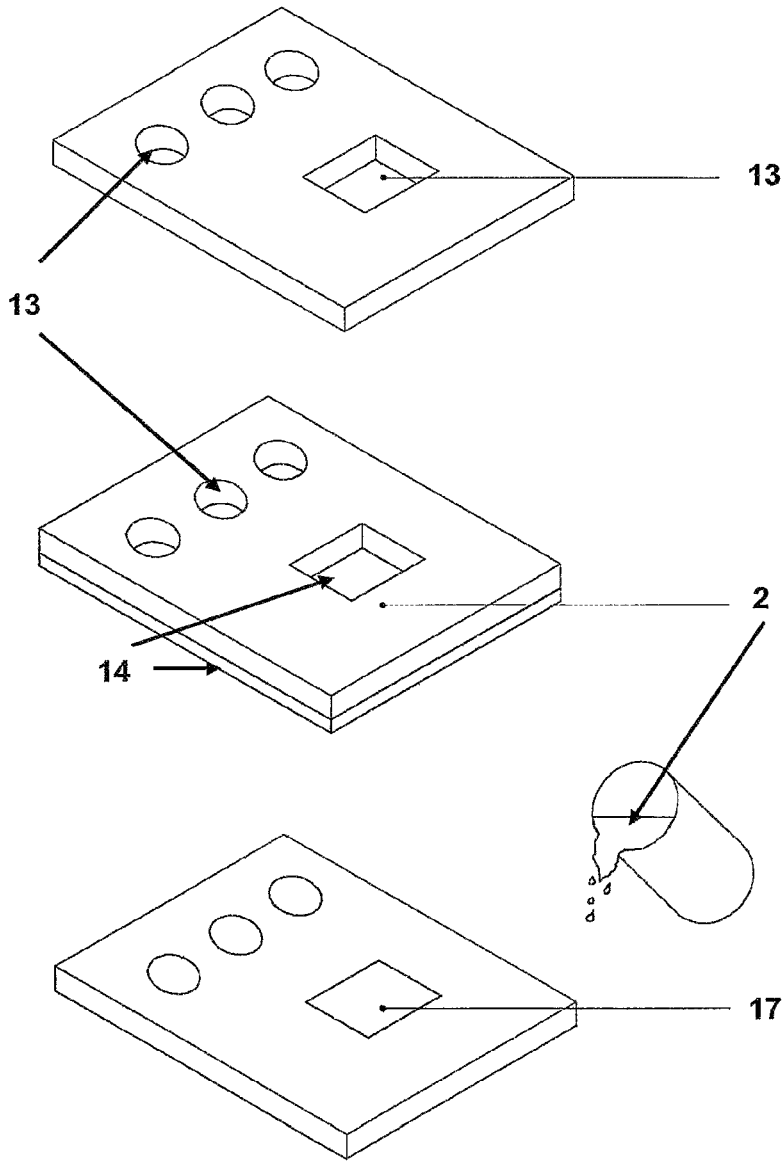
Figure 11:
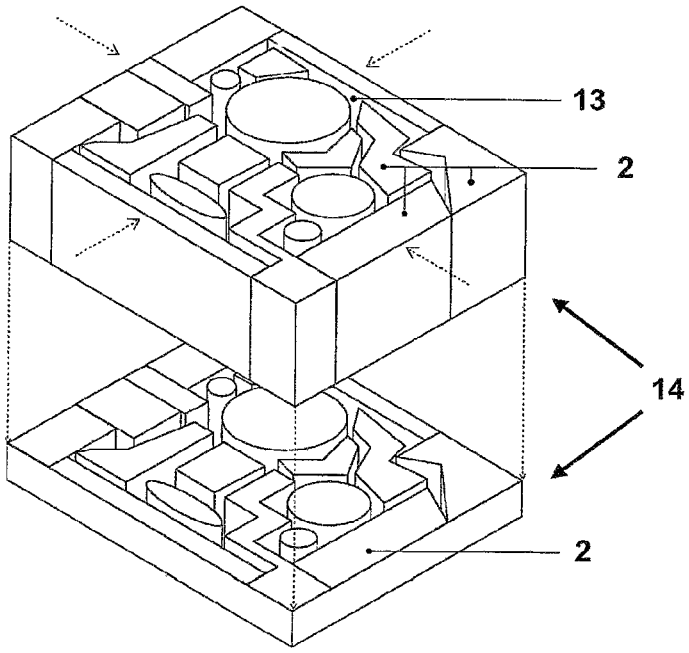
Figure 12:
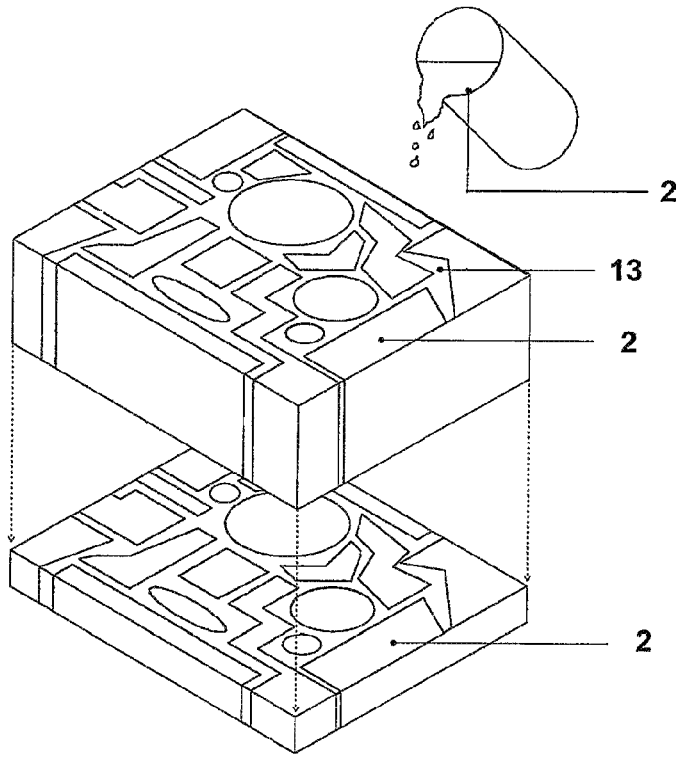
Figure 13A:
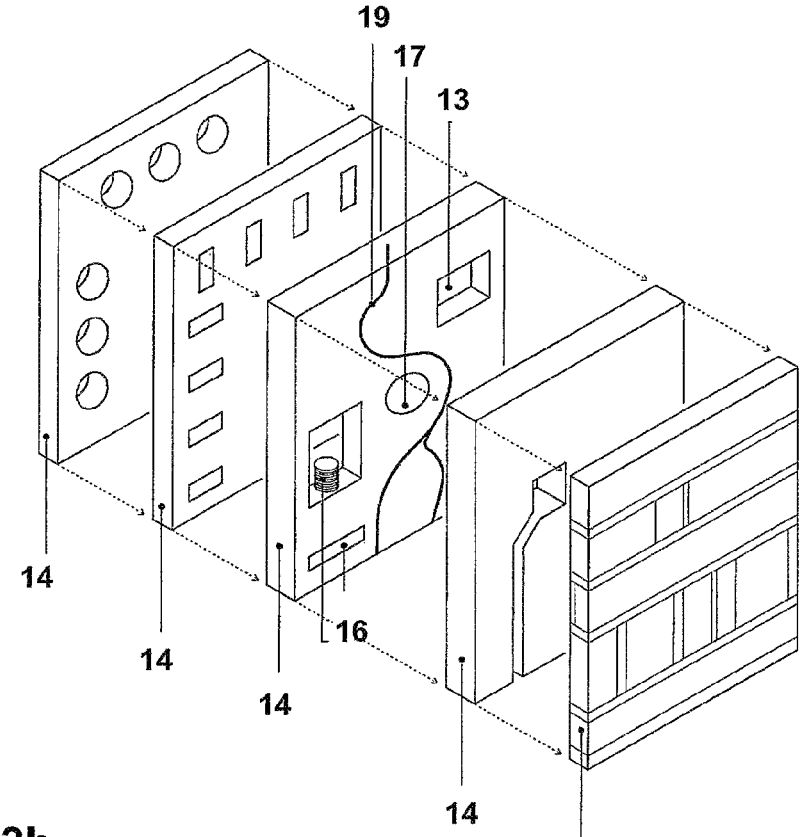
Figure 13B:
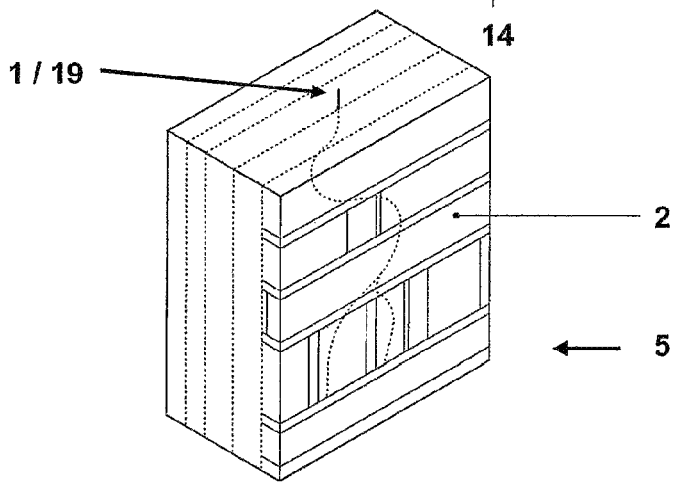
Figure 14A:
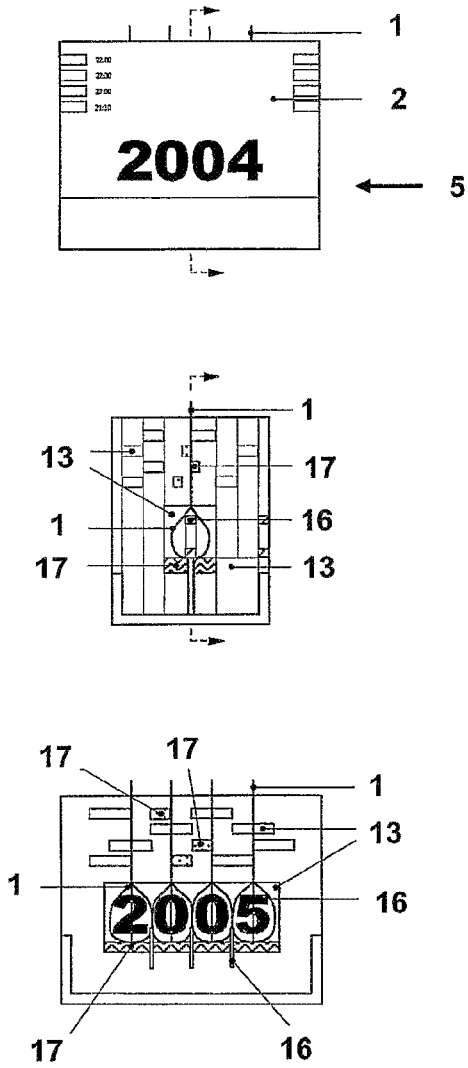
Figure 14B:
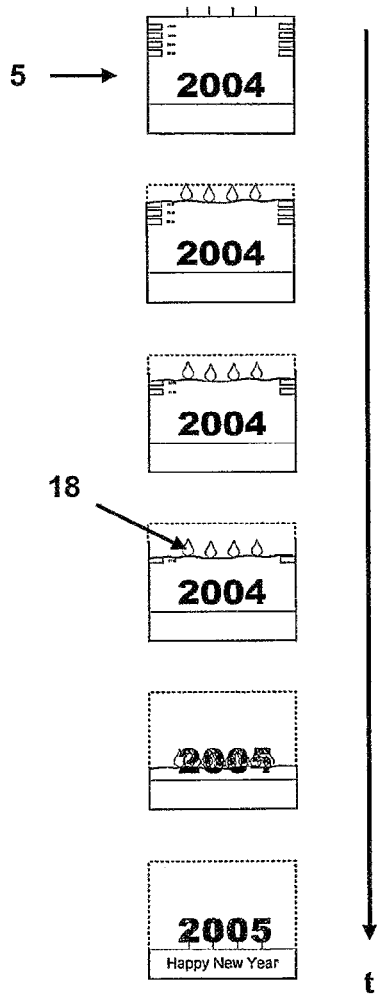
Figure 15A:
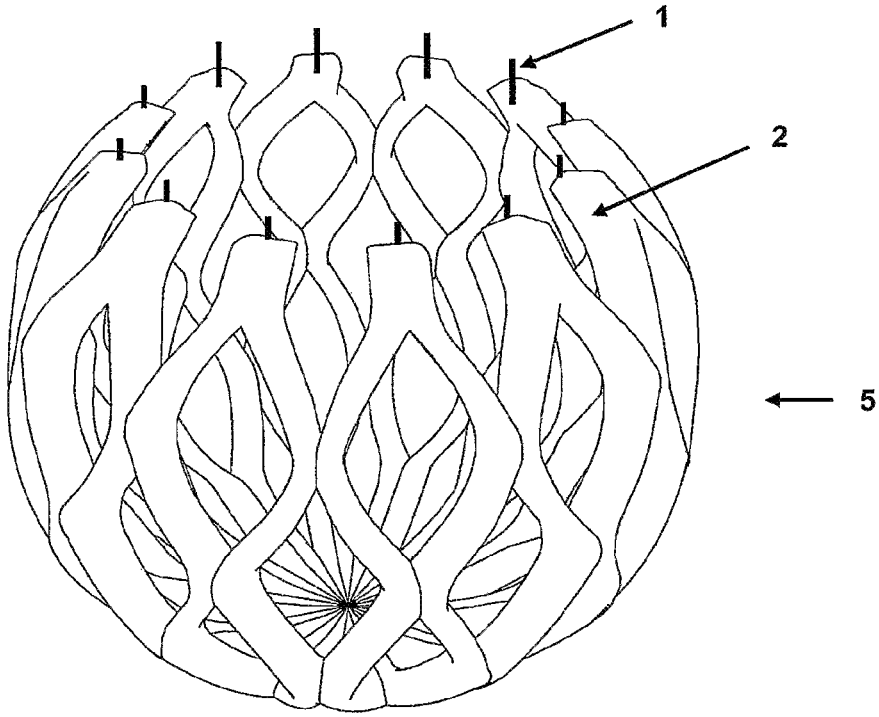
Figure 16A:
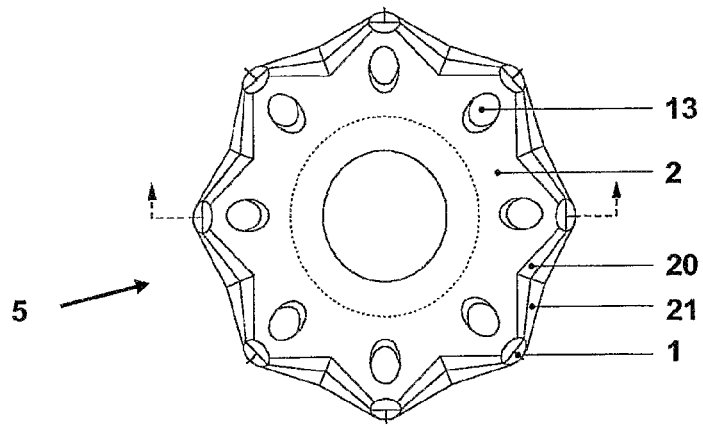
Figure 16B:
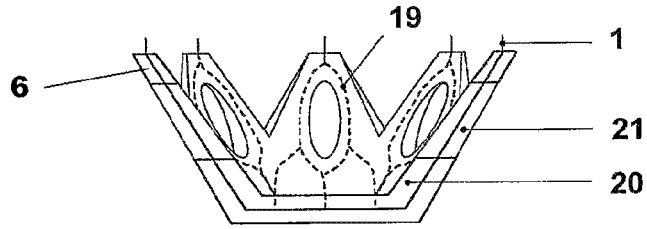
Figure 16C:
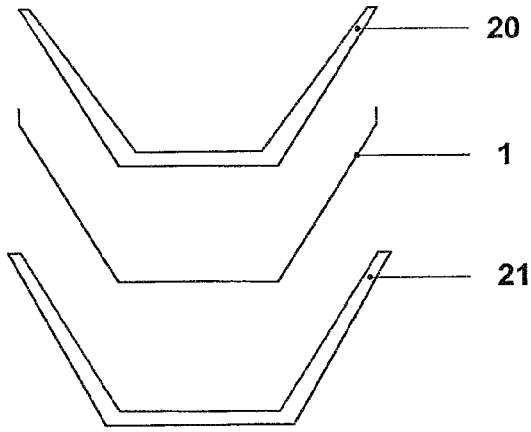

Further advantageous measures can be found in the following dependent claims; the invention is described with reference to embodiments and the following figures; these show:

FIG. 1: apparatus for a horizontal production method to produce stump candles FIG. 2: structure of a candle made up of segments FIG. 3*a*: schematical lateral view of a candle made up of two-dimensionally combined segments FIG. 3*b,c* schematical view of a candles made up of two-dimensionally combined segments with simple branching FIG. 4*a,b* schematical view of candles made up of two-dimensionally combined segments with double (FIG. 4*a*) or triple (FIG. 4*b*) branching FIG. 5*a,b* schematical description of the production method for a candle with multiple flames FIG. 5*c* schematical specification of the number of flames on the multiple levels of a candle with multiple flames FIG. 6 elevation and illustration of the wick's extent in a candle with multiple flames FIG. 7 *a, b* schematical illustration of the production method for a three-dimensional candle with multiple flames FIG. 7*c* schematic illustration and view on the plane of rotation of a three-dimensional candle with multiple flames FIG. 8 production of wax slabs with cavities FIG. 9 combination of cured inflammable masses with cavities FIG. 10 insertion of decorative elements into wax slabs with cavities FIG. 11 schematic view of slabs with complex cavities FIG. 12 insertion of decorative elements into slabs with complex cavities FIG. 13*a* exploded view of a candle made up of slabs with a branched wick as well as decorative and functional elements FIG. 13*b* exterior view of a candle, made up of slabs with a branched wick as well as decorative and functional elements FIG. 14*a* exterior view (top), cross section (middle) and longitudinal cut (bottom) of a New Year's Eve candle with functional and decorative elements FIG. 14*b* time bar (t) of the New Year's Eve candle's forms of appearance of FIG. 14 during the burning down process FIG. 15*a,b* spatial depiction of a hollow, spherical candle with multiple wicks FIG. 16*a* schematical oversight on a hollow, spherical candle with multiple wicks FIG. 16*b* cross section of a hollow, spherical candle with multiple wicks FIG. 16*c* exploded view of the layers of a hollow, spherical candle with multiple wicks FIG. 1 shows an apparatus for the horizontal production method, according to the invention, for stump candles, made up of an upper formed part 3*a* and a bottom formed part 3*b*. These formed parts 3*a*, 3*b* are used with the horizontal pouring method to each produce one half of the candle. Firstly, imprints of a positive of the candle in the making are taken, wherein containers, that contain the positives, are filled with a suitable material. The two formed parts 3*a* and 3*b* are preferably of silicone. An inflammable liquid mass 2 is now poured into the upper formed part 3*a* as well as into the bottom formed part 3*b*, until the liquid is flush with the upper edge of its respective formed part. After the inflammable material 2 is cured, a wick 1 is inserted into the candle 5 to be made. This is done preferably by placing it on top of the bottom formed part 3*b*. After the wicks 1 are put into place, the upper formed part 3*a* is now fitted on the lower formed part 3*b*. That way, the two halves of the candle in production 5 are put together to one candle assembly 4. After joining the two halves of the candle, the two formed parts 3*a*, 3*b* are removed. The candles 5 that are still in a candle assembly 4 are now separated. That way, single candles 5 are obtained.

FIG. 2 depicts the build-up of a candle made of segments. There is a wick 1 in each segment. This wick 1 preferably runs centrally orientated in the inflammable material 2. The segments 6 shown in FIG. 2 each show a simple branching 8. The segments 6 comprise special leads 7 for a fitting them together. Herein, the wick 1 protrudes from the segment at the top thereof. Furthermore, either a segment 6 comprises a lead 7 at its top side, or at its bottom side. The segments 6 in FIG. 2 feature the lead 7 on its respective top side.

A schematical lateral view of a candle made up of segments 6 is depicted in FIG. 3*a*, which segments are combined two-dimensionally, breadthways as well as aloft. Herein, the segments 6 feature respectively different forms and extents of branching. E.g. there are segments with doubled branching 8*b* and triple branching 8*c*. Through the combination of segments 6 breadthways as well as aloft, a spatial candle is created.

Figure 3C:
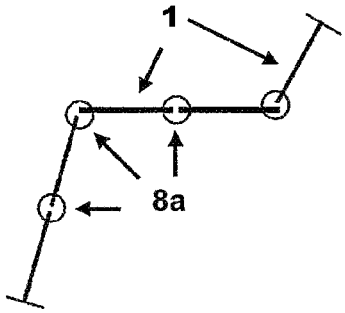

A schematical view in FIGS. 3*b* and 3*c* shows that the individual segments can take different spatial embodiments. In both figures show, just simple branching 8*a* are shown, which are comprised by the segments 6, and connect them with each other. By such a combination of simple branching 8*a* and segments 6, a linear candle object (FIG. 3*b*) as well as an angular candle object (FIG. 3*c*) can be obtained.

In FIGS. 4*a* and 4*b*, a schematical view of a combination of segments 6 for the construction of a candle with double branching 8*b* (FIG. 4*a*) is depicted. In FIG. 4*b*, combinations of a triple branching 8*c* with simple branchings for the connection of candle segments is displayed. FIGS. 4*a* and 4*b* demonstrate that with the application of the branching and segments, according to the invention, diverse three-dimensional scopes of design in regard of the candle's branching can be achieved.

FIGS. 5*a* and 5*b* depict a schematical illustration of the process for producing a candle 5 with multiple flames. As described in FIG. 1, an upper formed part 3*a* and a bottom formed part 3*b* are used therein. These had been obtained by casting of a positive of the candle to be produced. The wick tree 19 is then arranged between the formed parts 3*a*, 3*b*. The wick-tree 19 used in this example relates to a wick 1 with branchings, and thinly coated by a cured, inflammable layer to fix it in a desired form.

At the start of producing a candle with multiple flames, both formed parts 3*a*, 3*b* respectively are filled with inflammable materials. As soon as this is cured, the wick-tree 19 is placed onto the inflammable material of the bottom formed part 3*b*. Both formed parts 3*a*, 3*b* are joined contiguously, and the wax halves of the candle to be produced, that consist of the cured inflammable mass 2, are joined together. The wick-tree 19 protrudes from the inflammable material on one end of the candle.

To the right of FIG. 5*c*, there is depicted a multi-flamed candle produced according to the method illustrated in FIGS. 5*a* and 5*b*. It is provided in a base 9. On the top side, the wick-tree 19 projects from the inflammable material 2. To the right of FIG. 5*c*, small arrows indicate the cross-sectional planes as well as the direction of view onto the respective cross-sectional planes. A dashed line to the left in FIG. 5*c* indicates the respective view on the indicated sectional plane.

The wick-tree 19 coated with inflammable material 2 is visible. It is also well visible that, different numbers of ends of the wick-tree 19 protrude from the inflammable material 2 in each of the different sectional planes. During burning down of the candle 5, it is caused to burn with a corresponding number of flames in the respective sectional planes. For example, the candle 5 starts out with only one flame which branches out into three flames. These three flames branch out further to four flames in the process just to reduce its number again to only one flame, right above the base 9.

FIG. 6 depicts the elevation of a candle with multiple flames with regard to the wick's lead. It is also intended, according to the invention, that the wick's lead does not necessarily have to be constituted by a wick-tree 19 which is interconnected to all spots. In fact, parts of the wick-tree can for example be connected by wire 10. This ensures that the flames burn down evenly in a horizontal plane. This ensures the effect of a changing number of flames in the respective sectional planes. Thus, to control the burning behaviour, interruptions of the wick-tree 19 or wire leads 10 are provided.

FIGS. 7*a* and 7*b* show a schematical illustration of the production method for a three-dimensional candle with multiple flames 5. For this candle 5, too, halves of the candle 5 to be produced are first cast into a top formed part 3*a* and a bottom formed part 3*b*. This is done using the horizontal casting method, according to the invention, as described in FIGS. 1 and 5*a,b*. A the wick-tree 19 is centrally placed on the inflammable mass of the formed part 3*b*. However, the wick-tree now comprises a central wire lead. After the formed parts 3*a*, 3*b* have been contiguously joined, the inflammable material 2 of the candle 5 to be produced is joined. After releasing the interconnected parts of the candle 5, it can be released from the formed parts 3*a*, 3*b* (FIG. 7*b*, to the right).

On the right in FIG. 7*c*, the lateral view of a three-dimensional candle 5 with multiple flames is depicted with indication of the sectional planes of the views of the right part of FIG. 7*c*. The candle 5 stands in a base 9. In the part to the right, small rotational circles (arrows) indicate the orientation of the wire lead. This allows for the rotation of the symmetrical objects about this axis. The wick-tree 19 features in each case connections along the axis of the wire lead.

In FIG. 7*c* to the right, the sectional plane indicate the orientation of the view in the left part of FIG. 7*c*. The parts of the candle that have been interleaved into one another can now rotate on circular paths 12, which match their respective outer diameter. Because the diameters differ, the elements can freely rotate along the axis of rotation. That way, a three-dimensional candle is created which was made according to a two-dimensional horizontal casting method.

FIG. 8 shows the production of wax slabs with cavities 13. Thereto, spacers 15 are inserted into a inflammable material 2. After removing the spacers 15 (indicated by arrows), cavities are generated in the inflammable material 2. These correspond to the form of the spacers 15. Alternatively, the cavities 15 may be obtained by cutting, sawing or milling.

FIG. 9 depicts the combination of cured inflammable materials 2 that comprise cavities 13. The cavities 13 of different segments 6 do not necessarily have to feature the same shape (not depicted).

FIG. 10 shows how decorative elements 17 are inserted into the cavities 13 of a cured inflammable mass 2. In this process, the cavities 13 are closed at the bottom with a slab 14. Liquid inflammable mass 2 is poured into these cavities, which are now closed at the bottom. After curing, the segment 6 features a decorative element.

A slab 14 may also be used to close a cavity at the bottom if this is not filled with curable inflammable mass 2, but e.g. with a fragrant oil or coloured liquids (not depicted).

FIG. 11 displays a schematical view of slabs with complex cavities 13. These cavities 13 are located between cured inflammable mass 2. Depicted are respectively 2 segments 6 with cavities 13. Small arrows indicate that combining and nesting of wax parts from different cured inflammable masses 2 can lead to the creation of the cavities 13.

FIG. 12 shows that cavities 13 located between the cured inflammable masses 2 can be filled by pouring still liquid inflammable material 2 or fragrant oils into it. That way, decorative elements according to the present invention are incorporated.

In FIG. 13*a*, an exploded drawing depicts a candle made up of slabs with branching wick 19 as well as decorative and functional elements 16, 177 and cavities 13. In the respective slabs 14 which are made up of inflammable cured material, cavities 13 of various shapes are provided. These cavities may be filled with functional elements 16, if desired. This may relate to noise making elements or objects that only become visible while the candle burns down. Furthermore, these slabs also comprise decorative elements 17, such as differently coloured wax fillings of cavities 13 or cavity fillings with fragrant oils or coloured liquids.

FIG. 13*b* displays the outer appearance of a candle which is put together of the slabs 14 shown in FIG. 13*a*. At the top, the wick 1 or a wick-tree's peak 19 projects from the candle. At the sides of the candle, the differently structured, cured inflammable masses 2 are visible. These structures may be obtained by the purposive stratification of horizontally cast wax slabs.

FIG. 14*a* depicts, at the top, the outer appearance of a candle 5 that features functional and decorative elements. In this case, it relates to a New Year's Eve candle 5. At the top, a plurality of peaks of a wick 1 protrude. The candle 5 itself is made up of a cured inflammable mass 2 featuring the number "2004".

The arrows in the upper part of FIG. 14*a* indicate the sectional plane which is depicted in the middle of FIG. 14*a*. This cross-section also shows the wick's path, that branches to another functional element in the central part. In this case, the element 16 is the digits of the number "2005". Furthermore, the candle features cavities 13 and decorative elements 17.

In the middle of FIG. 14 *a*, the smaller arrows indicate the sectional plane of the lower part of FIG. 14*a*. This cross-section is a longitudinal section of the New Year's Eve candle. In this longitudinal section, too, the path of the branching wick 1 is visible to the digits of the number "2005". Furthermore, the candle features cavities 13 in which the respective digit of the number 2005 are located. The candle features decorative elements 17. The digits of the number 2005 are considered to be functional elements. The rods, that serve as holders of the digits, are also functional elements in the sense of the present invention.

FIG. 14*b* displays along a time line t the respective appearance of the New Year's Eve candle 5, which is build up as depicted in FIG. 14*a*. The candle starts out displaying on its outside the number 2004 which, while burning down, is replaced by the number 2005 which was hidden inside the candle. The burning behaviour can be controlled through the cavities and functional elements 16, 177, respectively, such that the number 2005 becomes visible only at a definite moment. In this case, this would obviously preferably relate to the time of the actual turn of the year.

Figure 15B:
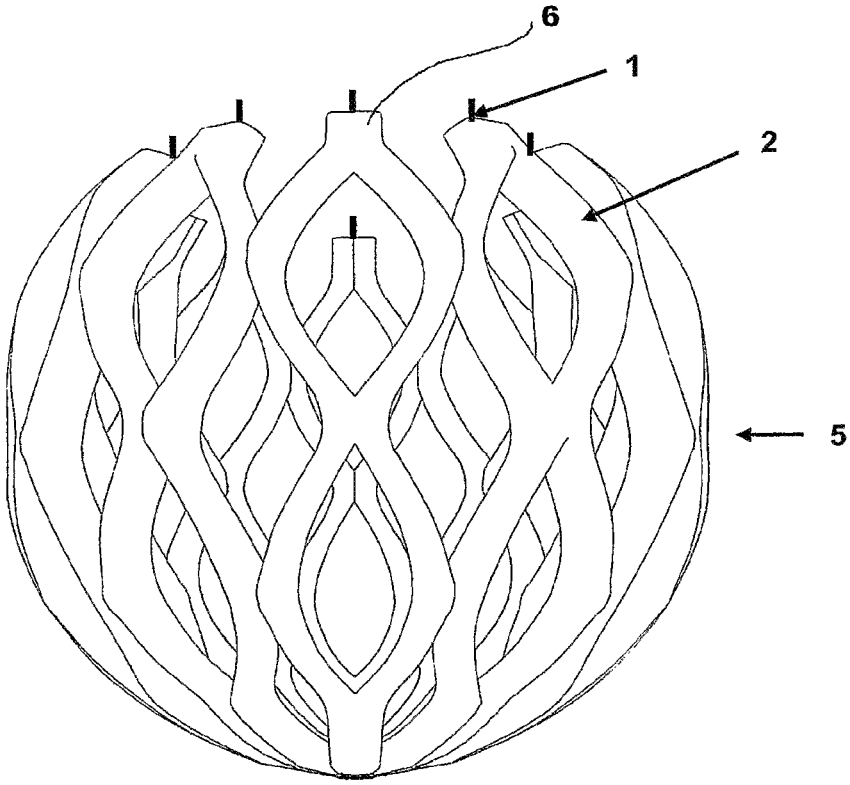

In FIGS. 15*a* and 15*b*, a three-dimensional candle 5 with three flames is spatially depicted. The wick 1 at the top of the hollow orbicular three-dimensional candle as well as the cured inflammable mass 2 are visible.

FIGS. 16*a-c* show a schematical view of a hollow orbicular candle with multiple wicks 5 (FIG. 16*a*), the plane of cross-section being indicated (FIG. 16*b*), as well as a schematical exploded drawing of the layers (FIG. 16*c*). In FIG. 16*a*, it is shown that the candle comprises cavities 13. Furthermore, the candle is made up of two layers, namely an inner wax form 20 and an outer fax form 21. In between, at the indicated positions, a respective wick 1 is located.

In FIG. 16*a*, the sectional plane is indicated which can be found in FIG. 16*b*. It becomes clear, that wicks 1 are the ends of a wick-tree 19 which branches around the cavities 13. The inner wax form 20 and the outer wax form 21 can be seen in the cross section of FIG. 16*b*.

In FIG. 16*c*, the exploded view of the inner wax form 20 as well as the outer wax form 21 with the wick 1 between them is visible.

Every embodiment in the figures is solely an exemplary depictions and not to be construed as limiting depictions of embodiments according to the invention.

| list of reference numerals | |
|---|---|
| 1 | wick |
| 2 | inflammable mass |
| 3a | upper formed part |
| 3b | lower formed part |
| 4 | candle assembly |
| 5 | candle |
| 6 | segment |
| 7 | lead |
| 8a | simple branching |
| 8b | double branching |
| 8c | triple branching |
| 9 | base |
| 10 | wire |
| 11 | axis |
| 12 | circular path |
| 13 | cavity |
| 14 | slab |
| 15 | spacer |
| 16 | functional element |
| 17 | decorative element |
| 18 | flame |
| 19 | wick-tree |
| 20 | inner wax form |
| 21 | outer wax form |

The invention claimed is:

1. A candle with decorative and/or functional elements with at least one inflammable wick, comprising at least one segment (6) which is made up of a cured inflammable mass (2), wherein a segment (6) is composed of at least two layers in a geometrical form, and at least one inflammable wick (1,19) that extends within the geometrical form, wherein the wicks (1, 19) of neighbouring segments do not touch and are situated in such a distance to each other in and between the individual candle segments (6), that the flame is capable of jumping from one wick (1,19) to the next within the segment (6) or within the respective next segment (6), while the candle (5) is burning down and the wicks (1, 19) are thinly coated and fixed in a desired form by a additional cured, inflammable layer, wherein in a respective upper candle segment (6) the wick(s) (1,19) project from the inflammable mass (2), and in a central candle segment (6) the wick(s) (1,19) does(/do) not protrude from the inflammable mass (2) and is(/are) fixed at the lower end by a lead (7), wherein the wick (1,19) is held at its lower end by a lead (7) in a respective lower candle segment (6).

2. The candle according to claim 1, wherein at least one segment (6) is curved and/or the wick (1,19) branches at least once, while in the case of branching linear wick sections (1) are present as well as elements, arranged at the respective ends, for connection (7) with additional segments (6).

3. The candle according to claim 1, wherein the inflammable mass (2), coating the wick (1,19), differs from the inflammable mass of the candle (5).

4. The candle according to claim 1, wherein the wick (1,19) comprises a lead made of metal (10) or glue.

5. The candle according to claim 1, wherein pigments in the inflammable mass (2) and/or in the wick (1,19) influence the burning behaviour, in particular in respect of the burning time.

6. The candle according to claim 1, wherein the wick comprises a porous material comprising gypsum.

7. The candle according to claim 1, comprising cavities (13).

8. The candle according to claim 7, wherein the cavities (13) are filled with different-coloured inflammable mass (2) and/or fragrant oils and/or liquids and/or objects and/or the cavities (13) have the shape of geometrical forms, numbers, letters or combinations thereof.

9. A candle with decorative and/or functional elements with at least one inflammable wick, comprising at least one segment (6) which is made up of a cured inflammable mass (2), wherein a segment (6) is composed of at least two layers in a geometrical form, and at least one inflammable wick (1,19) that extends within the geometrical form, wherein the wicks (1, 19) of neighbouring segments do not touch and are situated in such a distance to each other in and between the individual candle segments (6), that the flame is capable of jumping from one wick (1,19) to the next within the segment (6) or within the respective next segment (6), while the candle (5) is burning down and the wicks (1, 19) are thinly coated and fixed in a desired form by a additional cured, inflammable layer, wherein the inflammable mass (2), coating the wick (1,19), differs from the inflammable mass of the candle (5).

* * * * *